US007191628B2

(12) United States Patent
Shore

(10) Patent No.: US 7,191,628 B2
(45) Date of Patent: Mar. 20, 2007

(54) METHOD OF CONTINUOUSLY HOT ROLLING A HEATED BILLET INTO A PLURALITY OF FINISHED PRODUCTS

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/178,984

(22) Filed: Jul. 11, 2005

(65) Prior Publication Data

US 2006/0021411 A1 Feb. 2, 2006

Related U.S. Application Data

(60) Provisional application No. 60/592,201, filed on Jul. 29, 2004.

(51) Int. Cl.
*B21B 1/00* (2006.01)

(52) U.S. Cl. ..... 72/204; 72/234

(58) Field of Classification Search ..... 72/204, 72/203, 228, 234

See application file for complete search history.

(56) References Cited

U.S. PATENT DOCUMENTS

| | | | | |
|---|---|---|---|---|
| 1,977,285 | A * | 10/1934 | McCleery | 72/204 |
| 5,626,044 | A | 5/1997 | Lara-Castro | |
| 6,763,561 | B2 * | 7/2004 | Sclippa | 29/33 C |

FOREIGN PATENT DOCUMENTS

| | | |
|---|---|---|
| DE | 25 53 088 | 8/1976 |
| EP | 0 597 093 | 9/1991 |

* cited by examiner

*Primary Examiner*—Lowell A. Larson
*Assistant Examiner*—Debra Wolfe
(74) *Attorney, Agent, or Firm*—Gauthier & Connors, LLP

(57) ABSTRACT

A billet is initially rolled into a process section having at least first and second segments joined by an intermediate web, with the cross-sectional area of the second segment being larger than that of the first segment. The intermediate web is slit to separate the first and second segments, and the thus separated segments are simultaneously rolled into finished products having different cross-sectional areas.

3 Claims, 3 Drawing Sheets

METHOD OF CONTINUOUSLY HOT ROLLING A HEATED BILLET INTO A PLURALITY OF FINISHED PRODUCTS

CROSS REFERENCE TO RELATED APPLICATION

This application claims priority from Provisional Application Ser. No. 60/592,201 filed Jul. 29, 2004.

BACKGROUND OF THE INVENTION

1. Field of the Invention

This invention relates to the continuous hot rolling of heated billets that are slit in the course of being processed into finished products such as bars and rods.

2. Description of the Prior Art

In a conventional continuous hot rolling mill, an exemplary rolling diagram of which is depicted in FIG. 1, a typical billet 10 is initially heated to a temperature of about 1050–1150° C. The billet is then rolled in a series of roll stands 1V-12H/V arranged along a pass line P1 into a first process section 12. As shown in FIG. 2A, the first process section 12 has laterally disposed segments 14 of equal cross sectional area joined by an intermediate first web 16.

With reference again to FIG. 1, at 18, the first web 16 is slit to separate the segments 14, which are then directed to separate pass lines $P_2$ for continued rolling into second process sections 20 in roll stands 13H-16H/V. As shown in FIG. 2B, each of the second process sections also has laterally disposed segments 22 of equal cross sectional area joined by an intermediate second web 24.

At 26 as shown in FIG. 1, the second webs 24 are slit to separate the segments 22, which segments are then directed to separate pass line $P_{3a}$–$P_{3d}$ for rolling into finished products 28 in some or all of the roll stands 17–24 of finishing blocks "M".

Because the process sections 12 and 20 are slit into segments having equal cross sectional areas, the finishing blocks are each fed with the identical slit segments 22. This severely limits the range of products that can be produced by the mill with a given roll pass design and guide set up. By way of illustration, assume for example that the entering billet 10 measures 160×160 mm with a cross sectional area of 26,322 mm, that the slit segments 14 and 22 have respective cross sectional area of 32.4 $mm^2$ and 15.6 $mm^2$.

With reference to FIG. 3, and using the finishing block arranged on pass line $P_{3a}$ as an example, the following rolling sequences and resulting products are possible:

| ROLLING SEQUENCE | FINISH SIZE (DIAMETER) |
|---|---|
| 17-24 | 6.3 mm |
| 17-22 | 8 mm |
| 17-20 | 10 mm |
| 17-18 | 12.5 mm |

In order to produce other products, the mill must be shut down while the roll passes are reconfigured and guides are changed.

A primary objective of the present invention is to substantially broaden the range of products that can be rolled simultaneously with a given roll pass configuration in a mill in which slitting is employed.

A companion objective of the present invention is to achieve the aforesaid broadening of the product range while also increasing the hourly production rate of the mill.

SUMMARY OF THE INVENTION

In accordance with the present invention, a heated billet is initially rolled into a process section having at least laterally disposed first and second segments joined by an intermediate web, with the cross sectional area of the second segment being larger than that of the first segment. The web is then slit to separate the first and second segments. The first segment is then rolled into a first range of product sizes, and simultaneously, the second segment is rolled into a second range of larger product sizes.

BRIEF DESCRIPTION OF THE DRAWINGS

The invention will now be described in greater detail with reference to the accompanying drawings wherein.

DETAILED DESCRIPTION OF THE INVENTION

Figure 4:
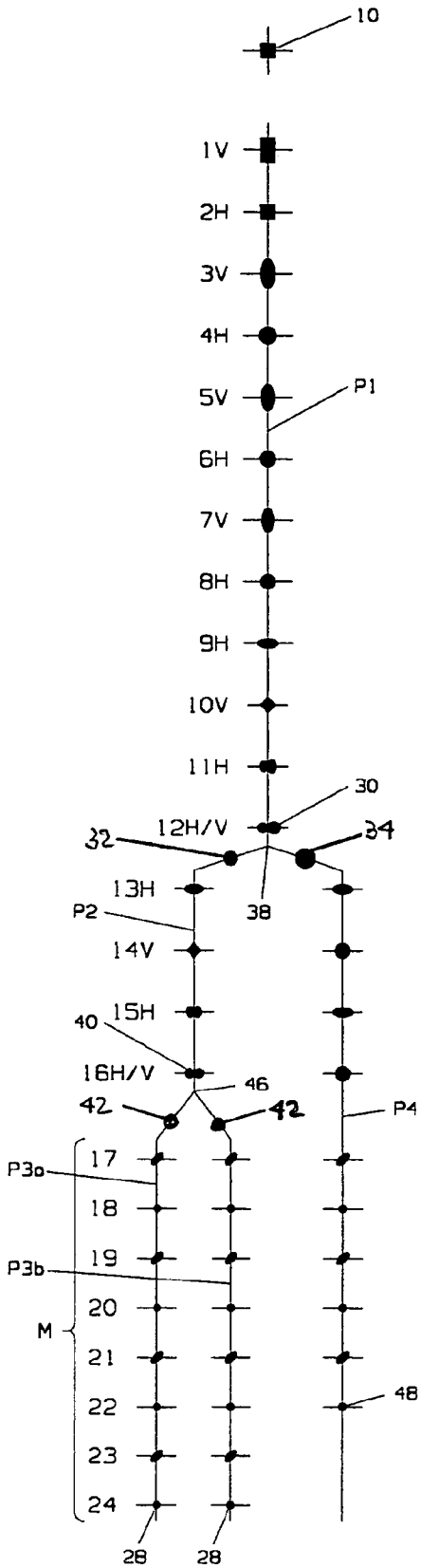
FIG. 4 is a rolling diagram of a rolling mill employing the slitting technique of the present invention.
Figure 2B:
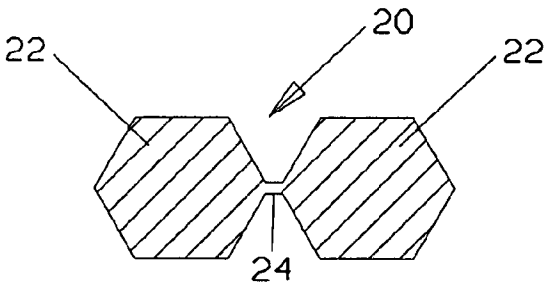
FIG. 2B (PRIOR ART)
FIGS. 2A and 2B are cross sectional views of process sections produced by the rolling mill of FIG. 1.
Figure 5B:
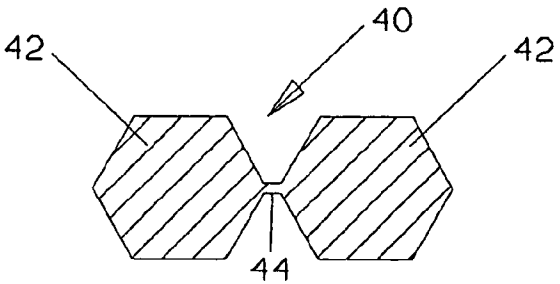
FIGS. 5A and 5B are cross sectional view of process sections produced by the rolling mill of FIG. 4.
Figure 2A:
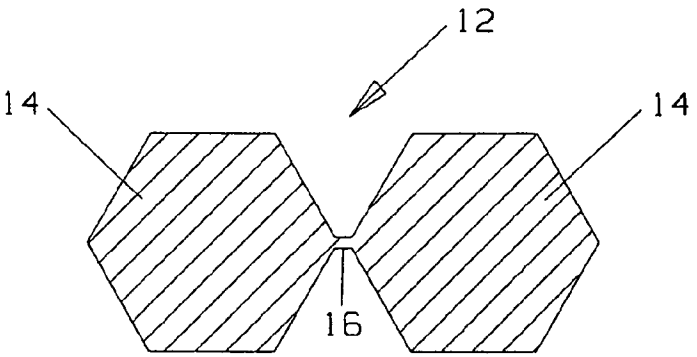
FIG. 2A (PRIOR ART)
Figure 5A:
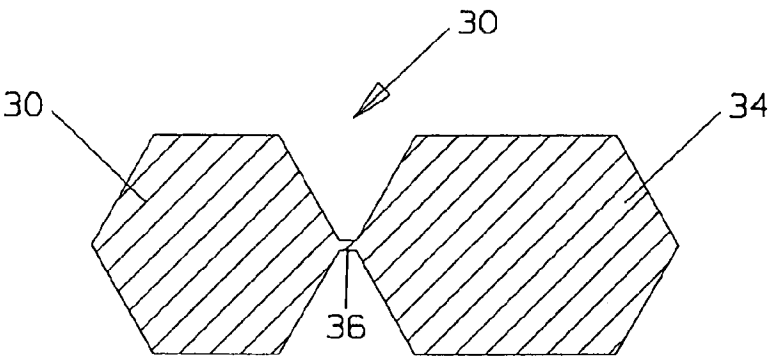

In accordance with the present invention, and as shown in FIG. 4, a heated billet 10 of the type previously described is rolled in a series of roll stands 1V-12H/V arranged along a pass line $P_1$ into a first process section 30. However, and as shown in FIG. 5A, unlike the previously described process section 12 where the segments 14 are of equal cross sectional area, the process section 30 has first and second segments 32, 34 of unequal cross sectional area joined by an intermediate web 36.

At 38 in FIG. 4, the web 36 is slit to separate the segments 32, 34. The smaller segment 32 is directed to a pass line $P_2$ where it is rolled in roll stands 13H-16H/V into a second process section 40. As shown in FIG. 5B, the second process section 40 is conventionally shaped, with third segments 42 of equal cross sectional area joined by an intermediate second web 44. At 46, the web 44 is slit to separate the third segments 42. The third segments 42 are then directed to pass lines $P_{3a}$ and $P_{3b}$ of the type shown in FIG. 1 for rolling into the finished products 28.

While the third segments 42 are being processed into finished products 28 in the roll stands of the pass lines $P_{3a}$, $P_{3b}$, the larger slit segment 34 is directed to a separate pass line $P_4$ for rolling into a larger range of finished products 48.

Figure 1:
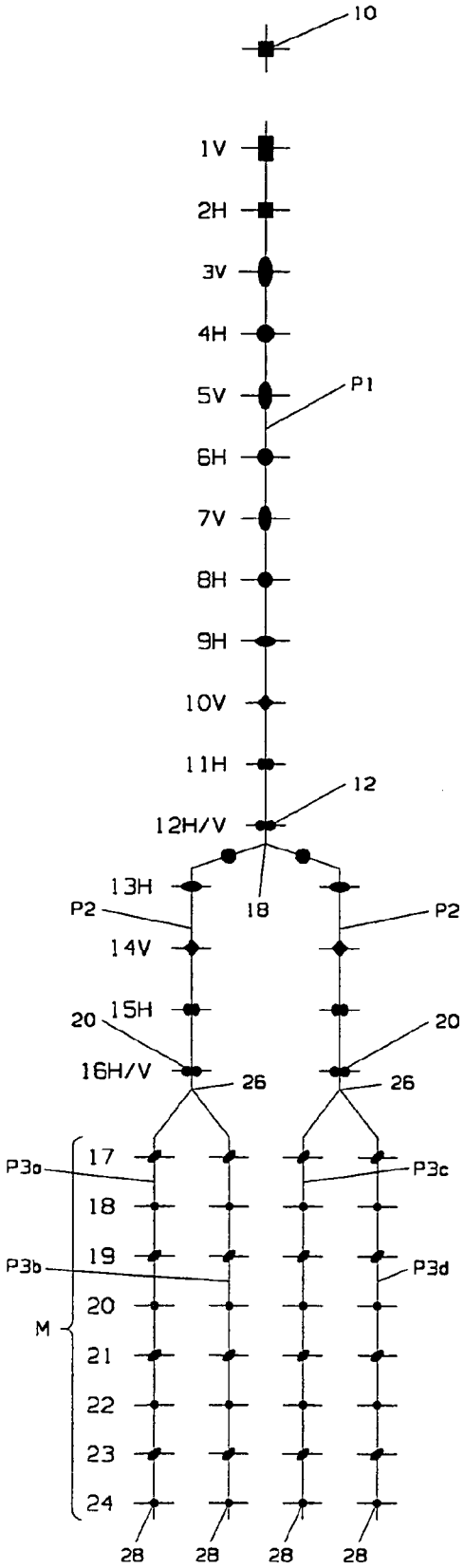
FIG. 1 (PRIOR ART)
FIG. 1 is a rolling diagram of a rolling mill employing conventional slitting techniques.
Figure 6:
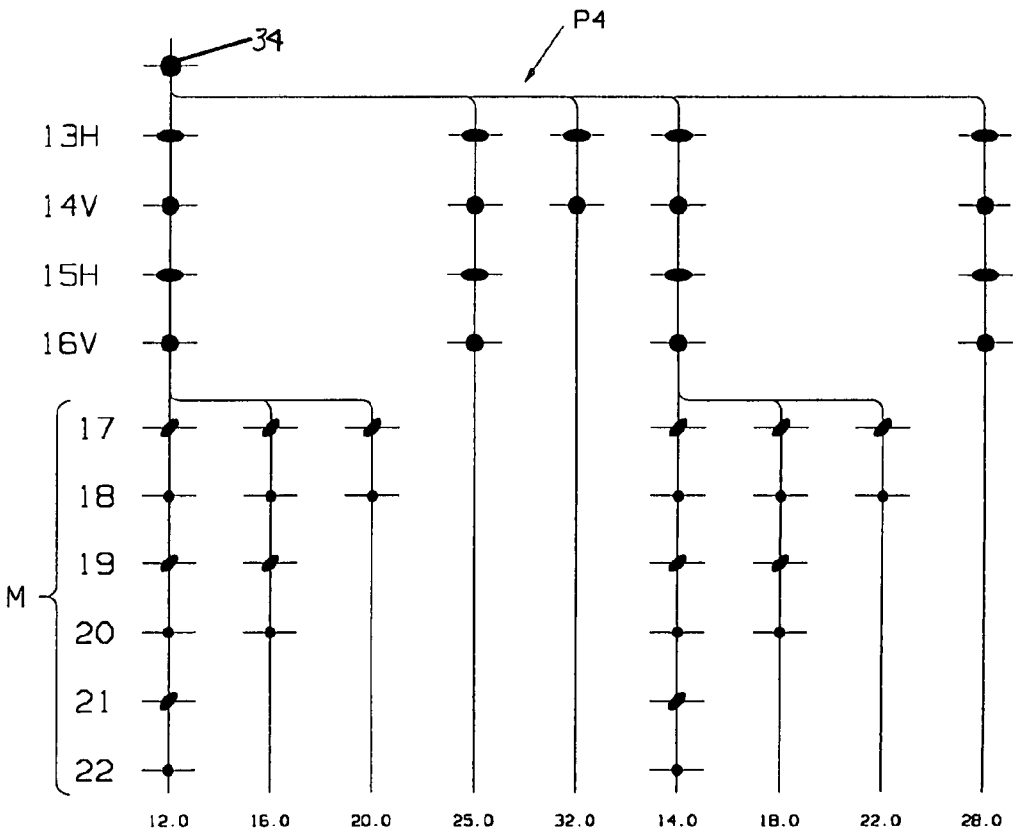
FIG. 6 is a rolling diagram of one of the pass lines shown in FIG. 4.
Figure 3:
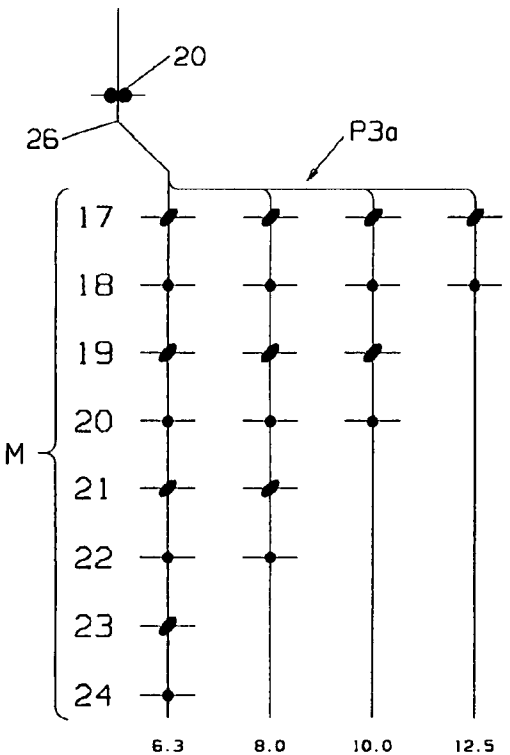
FIG. 3 is a rolling diagram of one of the finishing blocks shown in FIG. 1.

Again by way of illustration, assume that the entering billet 10 is the same as that described with reference to FIG. 1, that the first and second slit segments 32, 34 have respective cross sectional areas of 30 mm2 and 40 $mm^2$, and that the third slit segments 42 have cross sectional areas of 15.6 $mm^2$. With these dimensions, the finished products 28 produced by pass lines $P_{3a}$, $P_{3b}$ will be approximately the same as those previously described namely, rounds having diameters of either 6.3, 8.0, 10.0 or 12.5 mm. However, and as shown in FIG. 6, the following rolling sequences and finished products are possible when rolling the larger slit segment 34 on pass line $P_4$:

| ROLLING SEQUENCE | FINISHED SIZE (DIAMETER) |
|---|---|
| 13-22 | 12.0 mm |
| 13-20 | 16.0 mm |
| 13-18 | 20.0 mm |
| 13-16 | 25.0 mm |
| 13-14 | 32.0 mm |
| 13-22 | 14.0 mm |
| 13-20 | 18.0 mm |
| 13-18 | 22.0 mm |
| 13-16 | 28.0 mm |

It thus will be seen that by initially rolling and slitting the heated billet 10 to produce separated segments 32, 34 of unequal cross sectional area, those segments can then be processed further into different ranges of finished product sizes. This enhanced flexibility is achieved without having to shut the mill down in order to reconfigure the roll passes and change the guides.

The larger segment 34 of the process section 30 also makes it possible to increase the take in speed of the billet, which beneficially increases the hourly tonnage rate of the mill.

In light of the foregoing, it is to be understood that the above-described process sections and rolling diagrams are merely examples of those that may be employed in accordance with the present invention, the basic concept of which is the slitting of a process section into at least two segments of unequal cross sectional area, followed by the simultaneous rolling of the thus slit segments into different ranges of finished product sizes.

I claim:

1. A method of continuously rolling a billet into differently sized finished products, said method comprising:

rolling said billet into a first process section having at least first and second segments joined by an intermediate web, with the cross sectional area of said second segment being larger than that of said first segment;

slitting said web to separate said first and second segments; and simultaneously rolling the thus separated first and second segments into finished products having different cross sectional areas.

2. The method of claim 1 wherein one of said first and second segments is rolled into a second process section having third segments of equal cross sectional area joined by a second intermediate web; slitting said second intermediate web to separate said third segments; and rolling the thus separated third segments into said finished products.

3. The method of claim 1 wherein said billet is rolled into said first process section on a first pass line, and wherein said separated first and second segments are rolled simultaneously into said finished products on separate second and third pass lines.

* * * * *